United States Patent [19]

Kings et al.

[11] 4,294,903

[45] Oct. 13, 1981

[54] PROCESS FOR ELECTROSTATICALLY DEVELOPING AND PRESSURE-FIXING A REVERSED IMAGE INCLUDING CHARGE DISSIPATION PRIOR TO FIXING

[75] Inventors: Donald Kings, Saint Nicolas d'Aliermont; Pham K. Quang, Dieppe, both of France

[73] Assignee: Rhone Povlenc Systemes, Creteil, France

[21] Appl. No.: 174,130

[22] Filed: Jun. 31, 1980

[30] Foreign Application Priority Data

Aug. 8, 1979 [FR] France ..... 79 20264

[51] Int. Cl.[3] ..... G03G 13/22

[52] U.S. Cl. ..... 430/98; 430/100; 430/124; 430/903

[58] Field of Search ..... 430/31, 98, 100, 125, 430/124, 126, 903

[56] References Cited

U.S. PATENT DOCUMENTS 3,707,138 12/1972 Cartwright ..... 430/126

*Primary Examiner*—John D. Welsh

*Attorney, Agent, or Firm*—Sherman & Shalloway

[57] ABSTRACT

The sharpness and contrast of reversed images obtained by pressure-fixation of electrostatically developed copies of negative transparencies is provided by dissipating the electrostatic latent image after the development step but before the pressure-fixing step. The process finds application in microfilm reader/reproduction devices.

5 Claims, 9 Drawing Figures

PROCESS FOR ELECTROSTATICALLY DEVELOPING AND PRESSURE-FIXING A REVERSED IMAGE INCLUDING CHARGE DISSIPATION PRIOR TO FIXING

BACKGROUND OF THE INVENTION (1) Field of Invention

The present invention relates to an electrophotographic copying process for obtaining a reversed image (positive) of a negative using pressure fixing of a pressure-sensitive development powder (toner). More particularly, the present invention relates to a process for developing an electrostatic latent image by depositing a pressure-sensitive development powder on the uncharged areas (neutral areas) wherein the resulting positive reproduction is fixed by passing the developed image between pressure rollers.

(2) Discussion of the Prior Art

The reversed development of an electrostatic latent image is necessary when it is desired to reproduce a positive reproduction from a negative image or transparency. For example, reverse development is used in microfilm reader/reproducer machines. In reversed development processes, the development powder or toner is deposited in the uncharged or electrically neutral areas. Most typically, fixing of the development powder is accomplished by application of heat whereby the resin material of the development powder melts and becomes fixed or adhered to the copying paper. Images of good quality have been obtained by this procedure.

More recently, much effort has been devoted to fixing of the development powder by application of pressure. Pressure fixing has the advantage of being simple since it is merely necessary to provide metal rollers not requiring any complex procedures for their machining to a satisfactory surface condition.

Moreover, pressure fixing has the advantage that if the copying paper becomes jammed between the rollers, no likelihood of overheating or initiation of a fire results. This is in contrast to apparatus in which fixing is accomplished by heat, in which jamming of the copying paper can result in a fire in the machine.

Although apparatus using pressure fixing or reversed developed electrostatic latent images have been provided using metal rollers for the fixing, it has been observed that the resulting copies were of generally poor quality with regard to lack of sharpness and definition of the image.

SUMMARY OF THE INVENTION

It is, accordingly, highly desirable to provide an improved process for pressure fixing reversed developed electrostatic latent images in which the developed image is fixed by passing the developed image between metal rollers.

Such improved process is provided by the present invention in which developing and pressure fixing of a reversed image of a pressure-sensitive developing powder is accomplished by dissipating or neutralizing the electrostatic charges on the copying paper after development but before fixing by the metal pressure rollers. Accordingly, the present invention provides an electrophotographic copying process for obtaining a reversed image (positive) of an original negative transparency by uniformly, electrostatically charging a copying paper, dissipating the electrostatic charge in selected areas, corresponding to the transparent areas of the original negative, developing the copying paper by depositing toner on the selected areas, dissipating the remaining uniform electrostatic charge on the copying paper and fixing the toner by passing the copying paper between metal pressure rollers.

BRIEF DESCRIPTION OF THE DRAWINGS

The invention will be better understood from the following description and nonlimiting examples, in combination with the accompanying drawings in which.

DETAILED DESCRIPTION OF THE INVENTION AND PREFERRED EMBODIMENTS

Figure 1A:
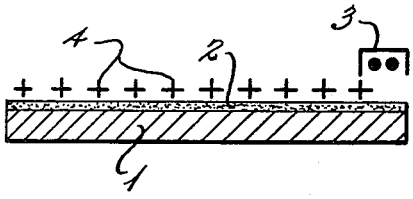
FIGS. 1*a*–1*f* represent the different stages in the formation of an electrostatic latent image and its reversed development and fixing in conformity with the invention.

The present invention is based upon the discovery by the inventors that causing the electrostatic latent image to disappear after the development but before the fixing of the toner does not cause any alteration or displacement of the toner and therefore enables one to obtain a positive image of excellent sharpness and definition.

In electrophotographic copying processes, two main categories of copying paper are generally used and either of these can be used in the process of the present invention. In one type of copying paper a photo-conductive layer on a support is provided for receiving the electrostatic latent image and in the other a nonphotoconductive dielectric layer on a support is provided for receiving the electrostatic latent image. Depending upon the type of layer used, the dissipation or neutralization of the remaining uniform electrostatic charge, defining the electrostatic latent image, can be implemented by appropriate procedures.

In the case in which a photo-conductive layer is initially, uniformly, electrically charged, formation of the electrostatic latent image, as well as the dissipation of the remaining charge, is accomplished by illumination of the copying paper by a suitable light source.

In the preferred embodiment of carrying out this procedure, the back of the copying paper, opposite the photo-conductive layer, will be illuminated through a slit extending over the entire width of the paper and which is arranged, transversely, with respect to the direction in which the slit advances across the surface of the paper. In practice, the slit may be fixed and the paper move across the slit or the paper may be fixed and the slit may be moved across the surface of the paper. It has been found that by carrying out the illumination in this manner, any likelihood of premature disappearance of the remaining uniform electrostatic charge before the reversed development can be avoided.

Typically, using a photo-conductive copying paper, the photo-conductive layer is uniformly, electrically charged by means of a Corona charging device or any other comparable piece of equipment and an electrostatic latent image is formed on the photo-conductive layer by exposing the layer to light through a negative original having transparent zones and opaque zones. The light transmitted through the transparent zones of the original impinges upon selected areas of the uniformly charged photo-conductive layer such that the illuminated areas are discharged, i.e., the charge in the selected areas is dissipated. The areas of the photo-conductive area which are not illuminated, corresponding to the opaque areas of the original, maintain their uniform electrostatic charge. The resulting latent electrostatic image may then be reversed developed according to conventional techniques.

Generally, a powdery developing agent or toner is deposited in the selected areas which have been illuminated to dissipate the electrostatic charge. This can simply be accomplished by one of various techniques using a powdery developing agent or toner carrying the same electrical charge applied to the photo-conductive layer.

When a nonphoto-conductive dielectric copying paper is used, the neutralization or disappearance of the remaining uniform, electrostatic charge, corresponding to the latent image, is achieved by contacting the latent image with an oppositely charged electrical force.

In carrying out this embodiment of the invention, it is preferred to first form the electrostatic latent image on a photo-conductive support by any conventional manner, such as that described above, and then to transfer the resulting image onto the dielectric support, again by procedures which are well-known in the art. For instance, reference can be made to the techniques described in French Pat. Nos. 1,105,940, 1,531,688, 2,164,412 and 2,208,542.

Of course, any known procedure for producing electrostatic latent images on a dielectric surface, such as the procedures used for recording electrostatic latent images in telecopiers and photocopying machines can be used in the present invention.

After the latent image has been reversed developed with a suitable toner powder or powdery developing agent, the latent image is dissipated, for example, by appropriate de-electrifying devices such as those described in French Pat. Nos. 2,106,779 and 2,142,242. By the de-electrification the remaining uniform electrostatic charge, defining the latent image, is caused to completely disappear leaving only the positive image provided by the deposited powdery toner particles.

In both embodiments, using the photo-conductive support or the nonphoto-conductive dielectric support, the latent electrostatic image is developed with a powdery developer or toner which is deposited in the uncharged areas. Any of the many well-known development methods can be used in the present invention.

For example, the cascade development method described in U.S. Pat. Nos. 2,618,551, 2,618,552 or 2,638,416 can be used. As is well known, in the cascade development method, a two-component developing powder is used which includes large carrier particles as support for fine, colored, developer (toner) particles. The toner particles are generally formed of a synthetic resinous material which can be triboelectrically charged. The particular resin chosen will carry a triboelectric charge in accordance with the electrostatic charge imparted to the copying paper. Thus, if it is desired to obtain negatively-charged developer particles, a resin located lower in the triboelectric series than the material constituting the charged support, which in this case will be positively charged, will be chosen.

In the cascade method, the carrier particles are generally spherical and do not take a direct part in the development. The carrier particles must be sufficiently massive to be able to flow by the force of gravity. Only the toner particles adhere to the copy paper.

Another development procedure is the "fur brush" technique described in U.S. Pat. No. 3,251,766. The "magnetic brush" development procedure is particularly preferred for use in this invention. In this type of development, the support or carrier particles contain magnetic materials and the magnetic brush is made up of a series of revolving magnets. These attract the magnetic materials to its surface. The generally nonmagnetic developer particles adhere to the magnetic support or carrier particles by their triboelectric property.

Single component or carrierless developer particles can also be used in the process of this invention and, in fact, are preferred. The carrierless developing powders or toners are formed by mixing magnetic particles such as ironoxides with a resinuous material. The magnetic particles are transferred in response to the action of an external electric field. The resin material used will generally have better electrical conductivity when used for developing a photo-conductive copying paper than in the case of a nonconductive, dielectric copying paper, e.g., ordinary paper, plastic material, etc. In any case, an uncharged development powder image is obtained.

Single component or carrierless developer particles which are particularly adapted for pressure fixing are described, for example, in French Pat. Nos. 2,167,047, 2,167,143 and 2,235,404. Reference can be made to French Pat. No. 2,176,022, and particularly page 11, thereof, for details on a suitable development procedure using carrierless toner particles. Additional details and general background concerning electrostatic development processes and electrostatic toner or developing composition can be found, for example, in the following U.S. Pat. Nos. 3,239,465—Rheinfrank, 3,196,032—Seymour, 3,639,245—Nelson, 3,345,294—Cooper, 3,645,770—Flint, 3,925,219—Strong (pressure fixable), 3,933,665—Van Engeland, et al., 4,022,738—Shimada, et al., 4,082,681—Takayama, et al., Re 27,912—Miller.

The fixing of the developer particles by application of pressure is carried out using polished metal rollers capable of applying a pressure in the range of from about 2 to 100 kg/cm, preferably, between 10 and 70 kg/cm, wherein the pressure is calculated as the total force applied by the rollers against each other, divided by the length, in centimeters, of the contact between the rollers above and below the copying paper.

The roller which comes into contact with the image-bearing surface of the copying paper should be formed of a very hard material and should be electrically conductive. Preferably, all of the pressure rollers are grounded.

The invention will now be described by the following non-limiting example.

EXAMPLE

A sheet of electrophotographic copying paper, sold under the tradename REGMA M 100 BC, which consists of a support 1 and a photoconductive layer 2, is uniformly, electrically charged by a Corona discharge device 3 to provide positive charges 4 on the surface of the photoconductive layer. The Corona discharge device includes two wires spaced 6 mm from each other and is situated 17 mm from the copy paper (FIG. 1*a*). The paper is moved under the Corona discharge device at a speed of 7.7 cm/second while the Corona is supplied a continuous voltage of 6,500 volts. The residual surface voltage of the charged paper after 10 seconds is 270 volts. Voltage is measured on a Keithley Electrometer 610 B with a 2 501 sensor.

Figure 1B:
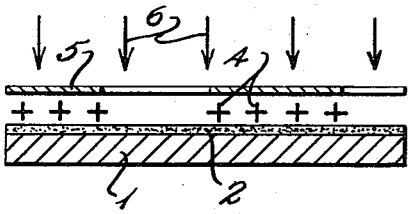

An original negative transparency 5 consisting of a glass Magenta screen (75% opaque) made up of pairs of equal black and white lines, which are perpendicular to each other, at a density of 150 pairs per inch, is placed over the uniformly charged copying paper as shown in FIG. 1*b*. Printing of the paper is carried out by exposing the copying paper through the screen to light rays 6. The source of light rays is a Philips Photocrescenta 150-watt bulb which delivers 61 luxes at the level of the photocopy paper. An enlargement ratio of 3:1 is used. As seen in FIG. 1*b*, in the illuminated areas of the photoconductive layer 2, the positive charge is dissipated and disappears.

Figure 1C:
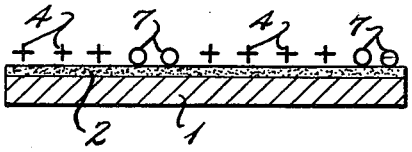

The resulting electrostatic latent image is developed with a negative, single component toner 7 suitable for pressure-fixing such as the toner sold under the tradename Hitachi HI-Toner HMT 601. As shown in FIG. 1*c*, the toner particles adhere to the copy paper only in the uncharged areas which correspond to the transparent areas of the original.

Development is performed using a fixed envelope magnetic brush made of aluminum and having movable magnets which turn at a speed of 500 rpm so as to move the toner powder in the direction of the breaking in of the copying paper.

The envelope of the magnetic brush is polarized by a positive continuous voltage of 310 volts. The distance between the envelope (without the toner) and the paper is set at about 0.5 mm, and the thickness of the toner is set at about 1 mm. The copying paper is moved along a metallic support which is grounded.

Figure 1D:
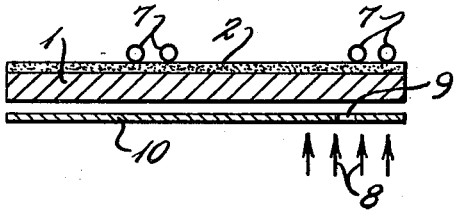

The discharging of the photoconductive layer of the copying paper by illumination is shown in FIG. 1*d*. A light source 8, capable of delivering 10,000 luxes is located about 3 cm below support 1. The illumination takes place through a slit 9 provided in opaque sheet 10. To enable a comparison to be made, the slit extends only over half the width of the copy paper. The lamp and opaque sheet 10 are moved across the paper at a rate of about 10 cm/sec. A slit with a width of about 2.5 cm is used. It is possible, of course, to maintain the light source and opaque sheet stationary while moving the copying paper lengthwise across the slit. By providing the slit only halfway across the width of the copying paper, it is possible to provide a good comparison of the difference in results obtained with and without discharging the photoconductor under the same experimental conditions.

Figure 1E:
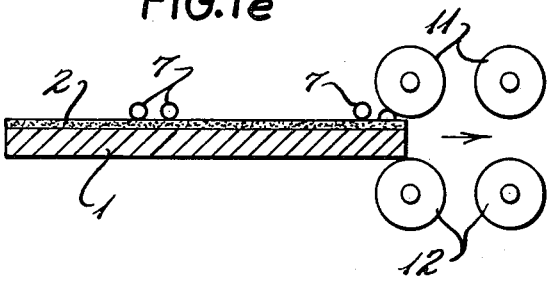
Figure 1F:
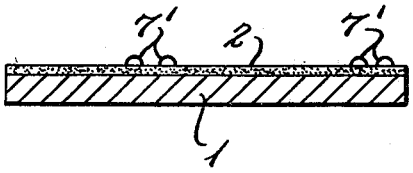
Figure 2:
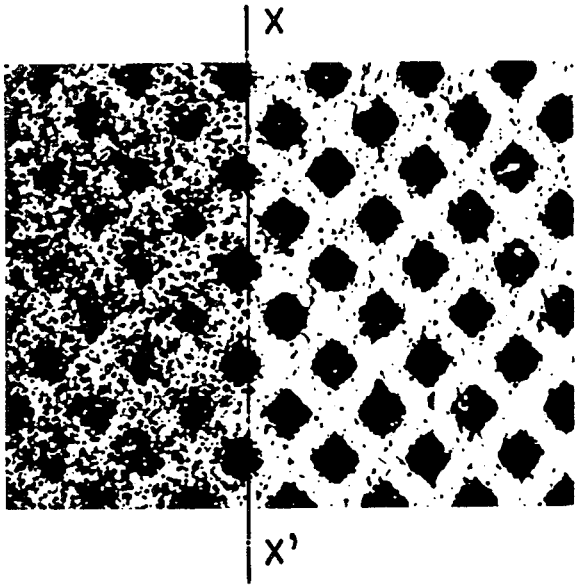
FIG. 2 is an enlarged photograph of a developed and pressure fixed image showing a comparison of the present invention to the prior art.
Figure 3:
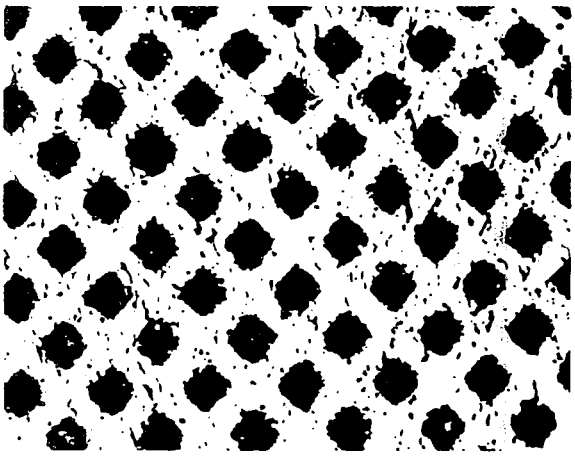
FIG. 3 is an enlarged photograph obtained according to the process of this invention and corresponding to the right half of FIG. 2.
Figure 4:
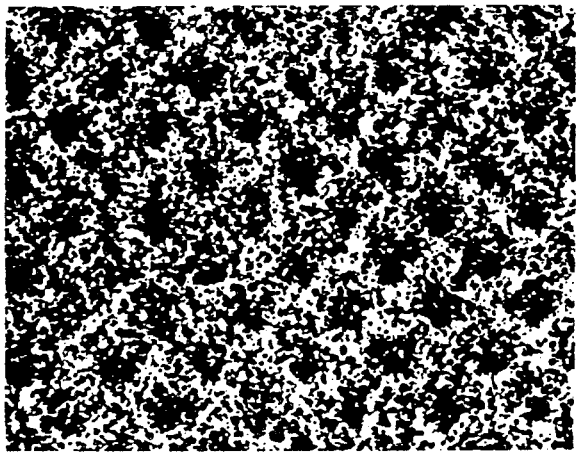
FIG. 4 is an enlarged photograph obtained according to the prior art process and corresponding to the left half of FIG. 2.

FIG. 1*e* illustrates the pressure fixing step in which four grounded metallic rollers 11, arranged two by two on both sides of the copying paper, are used. The copying paper is fed between the rollers which exert a linear pressure on the copying paper of about 10 kg/cm. As a result of the fixing step, the toner particles become embedded or affixed to the photoconductive layer as shown at 7' in FIG. 1*f*. FIGS. 2, 3 and 4 are enlarged photographs (enlargement ratio 22:1) of the fixed print.

In FIG. 2, the axis XX' represents the boundary of the illuminated area and the nonilluminated area before fixing.

The area which is discharged before fixing, corresponding to the right half portion of FIG. 2, is also shown in FIG. 3 and has a very white background with very sharp screen points. The average optical density of the white background area in FIG. 3, according to the present invention, measured by reflection with a neutral filter, using a Macbeth TP 524 Densitometer is 0.24.

The area which is not discharged before fixing, i.e., the left hand portion of FIG. 2, which is shown in FIG. 4, is nearly uniform and it is very difficult to distinguish between the white background areas and the dark screen points. The average optical density, in this case, is 0.41. For reference purposes, the optical density of the electrophotographic paper is 1.1.

Accordingly, it is seen that by following the process of the present invention in which the remaining uniform electrostatic charge, defining the latent electrostatic image, is dissipated or discharged, after the development step but before the fixing step, permits pressure fixation to be used without adversely effecting the quality of the resulting print.

What is claimed is:

1. In an electrophotographic copying process for obtaining a reversed image of an original negative transparency by uniformly electrostatically charging a copying paper, dissipating the electrostatic charges in selected areas corresponding to the transparent areas of the original negative, developing the copying paper by depositing toner on the selected areas and fixing the toner by passing the copying paper between metal pressure rollers, the improvement comprising, dissipating the remaining uniform electrostatic charge on the copying paper after the development step but before the fixing step.

2. The process of claim 1 in which the copying paper comprises a support and a photoconductive layer on said support, wherein the dissipation of the remaining uniform electrostatic charge is obtained by illuminating the support.

3. The process according to claim 2 wherein the illumination of the support comprises illuminating the back of the support through a narrow elongated opening located transversely with respect to the direction in which the opening advances, said opening extending over the entire width of the back of the support.

4. The process according to claim 1 in which the copying paper comprises a support and a nonconductive dielectric layer carried on the support and wherein the dissipation of the remaining uniform electrostatic charge on the copying paper is obtained by the emission of electrical charges having an opposite sign to the remaining uniform electrostatic charge on the copying paper.

5. The process according to claim 1, 2, 3 or 4 wherein the toner is a carrierless toner.

* * * * *